US007020952B2

(12) United States Patent
Watanabe et al.

(10) Patent No.: US 7,020,952 B2
(45) Date of Patent: Apr. 4, 2006

(54) METHOD FOR PRODUCING A GLOW PLUG

(75) Inventors: Shindo Watanabe, Aichi (JP); Masahiro Konishi, Aichi (JP); Katsuhisa Yabuta, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 419 days.

(21) Appl. No.: 10/304,744

(22) Filed: Nov. 27, 2002

(65) Prior Publication Data

US 2003/0126736 A1 Jul. 10, 2003

(30) Foreign Application Priority Data

Nov. 30, 2001 (JP) ..... 2001-367385
Oct. 21, 2002 (JP) ..... 2002-306313

(51) Int. Cl.
*H01C 17/02* (2006.01)

(52) U.S. Cl. ..... 29/613; 29/33 N; 29/611; 29/619; 29/860; 123/169 PB; 219/267; 219/270

(58) Field of Classification Search ..... 29/592.1, 29/601.1, 611, 613, 614, 619, 857–860, 867, 29/33 N, 620–621; 123/169 R, 169 CA, 123/169 PB, 145 A; 219/260, 267, 270; 361/253, 261, 264
See application file for complete search history.

(56) References Cited

U.S. PATENT DOCUMENTS 5,750,958 A * 5/1998 Okuda et al. ..... 219/267

FOREIGN PATENT DOCUMENTS

JP 06-051068 * 5/1995

* cited by examiner

*Primary Examiner*—A. Dexter Tugbang
*Assistant Examiner*—Donghai D. Nguyen
(74) *Attorney, Agent, or Firm*—Sughrue Mion, PLLC

(57) ABSTRACT

A green ceramic heater including a green heating resistor formed of an electrically conductive ceramic (e.g., silicide or carbide of a metal element such as W, Ta, or Nb) and an insulative ceramic (e.g., silicon nitride) and power supply leads (e.g., made of W), a first end of each power supply lead being connected to a corresponding end of the green heating resistor, the green heating resistor and the power supply leads buried in a green substrate formed of a material (e.g., silicon nitride) is fired, and subsequently, the resultant ceramic heater is heat-treated at 900 to 1,600° C., to thereby enhance flexural strength of the ceramic heater. The heat treatment is preferably carried out prior to forming a glass layer on an outer circumferential surface of the ceramic heater. When the heat treatment is performed after the fired ceramic heater has been polished so as to expose a second end of each power supply lead from a surface of the substrate, the heat treatment is preferably carried out in an inert atmosphere.

4 Claims, 3 Drawing Sheets

METHOD FOR PRODUCING A GLOW PLUG

BACKGROUND OF THE INVENTION

1. Field of the Invention

The present invention relates to a method for producing a ceramic heater exhibiting sufficient flexural strength, and not suffering fracture or similar damage in the course of production or use, and to a method for producing a glow plug incorporating the ceramic heater. The ceramic heater produced by the method of the present invention is useful as an element of the aforementioned glow plug employed for starting diesel engines and as a heating source employed in any of a variety of gas sensors, such as an oxygen sensor.

2. Description of the Related Art

Conventionally, a ceramic heater incorporating an insulative ceramic substrate (hereinafter also referred to as a "substrate") and a heating resistor buried in the substrate has been employed for starting diesel engines or for quickly activating various sensors. The ceramic heater is used particularly in glow plugs or similar devices, whose temperature must be raised to 1,200° C. or higher. Many ceramic heaters have a structure such that a heating resistor is buried in an insulative ceramic substrate, wherein the heating resistor contains an electrically conductive sintered ceramic comprising WC or $MoSi_2$, and the insulative ceramic substrate is formed of sintered silicon nitride ceramic and exhibits excellent corrosion resistance at high temperature. The insulative ceramic substrate comprises a pair of leads buried therein and made of a high-melting-point metal such as W for supplying power to the heating resistor (hereinafter also referred to as leads), wherein, for each lead, a first end is connected to a corresponding end of the heating resistor, and a second end is exposed on the surface of the substrate. Electricity is externally supplied through the leads to the heating resistor.

A conventionally known glow plug incorporating such a ceramic heater is generally configured such that a metallic outer sleeve surrounds the ceramic heater, and a metallic shell for mounting the glow plug on an engine surrounds the metallic outer sleeve. When a metallic sleeve is to be attached to a ceramic heater; more specifically, to a ceramic heater substrate formed of sintered silicon nitride ceramic, methods for attaching the metallic sleeve include a method wherein metal-ceramic joining is effected by use of an active brazing material. However, the above method is apt to result in variation in quality of the joined portions. In order to solve this problem, a joining method has been proposed which includes forming a glass layer on the heater, through baking, in order to enhance bonding of the brazing material to the heater, and then charging the brazing material into a space between the glass layer and the inner wall of the metallic sleeve.

The aforementioned conventional ceramic heater has a contact portion at which the substrate, the heating resistor, and the power supply leads, which differ in terms of physical properties (e.g., thermal expansion coefficient), are in contact with one another. Therefore, such difference in thermal expansion coefficient generates complex internal stress in the contact portion. The contact portion is the weakest portion of the ceramic heater. In the course of production or use of the ceramic heater, fracture is apt to occur at a certain part of a joint portion at which the heating resistor is joined to the power supply leads; i.e., a fitting portion, depending on the type of materials (e.g., ceramic) used to form the substrate and the heating resistor. Even when fracture is prevented, problematic cracking or a decrease in mechanical strength of the portion occurs. During the course of production of a glow plug incorporating the ceramic heater, when a metallic sleeve is fixed to the ceramic heater through brazing via a glass layer formed on the heater, a large stress is applied to contact portions at which the substrate, the heating resistor, and the power supply leads contact one another. Therefore, cracks may be generated at the contact portions between the heating resistor and the power supply leads, in the worst case leading to fracture of the ceramic heater.

In order to solve the above problems, for example, Japanese Patent Application Laid-Open (kokai) No. 7-282960 discloses a method including reducing stress concentration; specifically, rounding the tip of each lead, which is joined to one end of the heating resistor. Although the above method improves the structure of the ceramic heater, generation of complex stress cannot be completely prevented, the stress arising from differences in thermal expansion coefficient between the substrate, the heating resistor, and the leads. In addition, fracture or similar damage of the ceramic heater is not completely prevented. Furthermore, when the ceramic heater is assembled with a metallic sleeve, occurrence of problems such as fracture of the ceramic heater cannot always be prevented.

SUMMARY OF THE INVENTION

The present invention has been completed in order to solve the aforementioned conventional problems. Thus, an object of the present invention is to provide a method for producing a ceramic heater exhibiting sufficient flexural strength, and not suffering fracture (which would otherwise result from, for example, thermal shock) in the course of production or use. Another object of the present invention is to provide a method for producing a glow plug, which can prevent occurrence of problems such as fracture of the ceramic heater when the ceramic heater is attached to the metallic sleeve in the course of producing the glow plug.

The above first object of the present invention has been achieved by providing a method for producing a ceramic heater which comprises firing a green ceramic heater including a green substrate formed of an insulative ceramic powder, a green heating resistor buried in the green substrate, and a pair of power supply leads buried in the green substrate, each of said power supply leads having a first end connected to a corresponding end of the green heating resistor; and, subsequently, heat treating the resultant ceramic heater at a temperature of from 900 to 1,600° C.

The method for producing a ceramic heater of the present invention may further comprise polishing the fired ceramic heater after firing, to thereby expose a second end of each power supply lead at a surface of a substrate which has been obtained by firing the green substrate, and, subsequently, performing the heat treatment in an inert atmosphere.

In the method for producing a ceramic heater of the present invention, the heat treatment may be carried out for 10 minutes to four hours.

In the method for producing a ceramic heater of the present invention, the first end of each power supply lead may be buried in a heating resistor obtained by firing the green heating resistor, and the ceramic heater preferably has a 3-point flexural strength after heat treatment (Sa) measured according to JIS R 1601 (hereinafter 3-point flexural strength may also be referred to as "flexural strength") 5 to 35% higher than the 3-point flexural strength before heat treatment (Sn).

According to JIS R 1601, a load is applied to a surface of the substrate obtained by firing the green substrate in a region corresponding to the power supply leads buried in the ends of the heating resistor under a span of 12 mm and a crosshead moving rate of 0.5 nm/min.

In a second embodiment, the present invention provides a method for producing a glow plug having a metallic sleeve and a ceramic heater which includes a substrate formed of an insulative ceramic, a heating resistor buried in the substrate, and a pair of power supply leads buried in the substrate, a first end of each power supply lead being connected to a corresponding end of the heating resistor, and the ceramic heater being fixed inside the metallic sleeve, which method comprises firing a green ceramic heater in a heater forming step; heat treating the resultant ceramic heater obtained in the heater forming step at a temperature of from 900 to 1,600° C. in a heat treatment step; and fixing the heat-treated ceramic heater obtained in the heat treatment step inside the metallic sleeve in a brazing step, wherein the green ceramic heater includes a green substrate which is formed of an insulative ceramic powder and provides the substrate upon firing, a green heating resistor is buried in the green substrate and provides the heating resistor upon firing, and a pair of power supply leads which are buried in the green substrate, a first end of each power supply lead being connected to a corresponding end of the green heating resistor.

The method for producing a glow plug of the present invention may further comprise polishing the fired ceramic heater after firing in the heater forming step, to thereby expose a second end of each power supply lead at a surface of the substrate, and after the polishing, heat treating in an inert atmosphere.

The heat treatment may be carried out for 10 minutes to four hours.

In the method for producing a glow plug of the present invention, the ceramic heater may have a glass layer on its outer circumferential surface and the method comprises fixing the ceramic heater inside the metallic sleeve by brazing via the glass layer, and forming the glass layer on the outer circumferential surface of the ceramic heater in a glass layer forming step performed after the heat treatment step. Preferably, the highest temperature in the heat treatment step is set to a temperature equal to or higher than the highest temperature in the glass layer forming step.

According to the method for producing a ceramic heater of the present invention, when the ceramic heater obtained by firing a green ceramic heater is heat-treated at 900 to 1,600° C., internal stress generated in a contact portion can be reduced. This is the contact portion at which the substrate, the heating resistor, and the power supply leads, which differ in terms of physical properties (e.g., thermal expansion coefficient), contact one another. As a result, flexural strength can be enhanced in the vicinity of a portion at which the heating resistor is connected with the power supply leads. Therefore, problems such as fracture of the ceramic heater and generation of cracks in the vicinity of the aforementioned connection portion can be prevented during production of the heater or upon use thereof.

In the case where a second end of each power supply lead is exposed from the surface of the ceramic heater (substrate), flexural strength of the heater can be enhanced by heat-treating the ceramic heater in an inert atmosphere, while preventing oxidation of the power supply lead formed of, for example, tungsten (W) or W—Re (rhenium) alloy, and maintaining reliability of the power supply lead. When the ceramic heater is subjected to such heat treatment, flexural strength of the heater, which is evaluated using the specific method defined above, can be sufficiently improved, as compared with the case where the heater is not subjected to the above heat treatment.

According to the method for producing a glow plug of the present invention, heat treatment, at 900 to 1,600° C., of a ceramic heater which has undergone the heater forming step and has not yet been fixed inside the metallic sleeve by use of a brazing material can reduce internal stress generated in a contact portion at which the substrate, the heating resistor, and the power supply leads, which differ in terms of physical properties (e.g., thermal expansion coefficient), contact one another. As a result, flexural strength can be enhanced in the vicinity of a portion at which the heating resistor is connected with the power supply lead. Therefore, problems such as fracture of the ceramic heater and generation of cracks in the vicinity of the aforementioned connection portion can be prevented during production of ceramic heaters and production of glow plugs (e.g., assembly of the ceramic heater with a metallic sleeve (i.e., brazing step)), thereby providing a glow plug of high reliability.

When the method includes, prior to the heat treatment step, a polishing step for exposing a second end of each power supply lead from a surface of the ceramic heater (substrate) which has been fired, flexural strength of the heater can be enhanced by heat-treating, in an inert atmosphere, the ceramic heater which has been polished. This technique prevents oxidation of the power supply leads formed of, for example, W or W—Re alloy, and maintains reliability of the power supply leads.

No particular limitation is imposed on the method of the aforementioned "heat treatment," and a method including statically placing the fired heater in a heating furnace is preferred, from the viewpoint of simplicity of the apparatus and operation. The heat treatment is performed at a temperature of from 900 to 1,600° C., preferably 1,000 to 1,550° C., more preferably 1,100 to 1,500° C., most preferably 1,150 to 1,450° C. When the heat treatment temperature is lower than 900° C., flexural strength cannot be sufficiently enhanced, whereas when the temperature is higher than 1,600° C., a crystalline phase formed of, for example, a rare earth oxide of high melting point which is incorporated into the insulative ceramic substrate may be softened or melted, possibly lowering flexural strength.

No particular limitation is imposed on the heat treatment time, and the heat treatment is performed for 10 minutes to four hours, preferably 10 minutes to three hours. When the heat treatment time is shorter than 10 minutes, flexural strength cannot be sufficiently enhanced. Generally, heat treatment for approximately one to three hours can sufficiently enhance flexural strength. Heat treatment for longer than four hours raises no fatal problems, but such a long heat treatment is not preferred, since enhancement of flexural strength commensurate with prolongation of heat treatment cannot be attained. Although the heat treatment may be performed under ambient pressure, the treatment may also be performed under pressurized conditions or reduced pressure. Upon heat treatment of a sintered compact, the compact is maintained for a predetermined period of time at an arbitrary temperature falling within the aforementioned range. Alternatively, the treatment may also be performed for a predetermined period of time while the temperature is varied in accordance with a predetermined heating profile falling within the above temperature range.

No particular limitation is imposed on the atmosphere employed during the heat treatment, and the heat treatment may be performed in air. However, when the heat treatment is performed after the fired ceramic heater has been polished so as to expose a second end of each power supply lead from a surface of the substrate, the heat treatment is preferably performed in an inert atmosphere such as a nitrogen atmosphere or an argon atmosphere. This prevents oxidation of a metal such as W or W—Re alloy, which, as mentioned above, is often employed for leads. When the heat treatment is performed at a temperature higher than 1,500° C. and in a reducing atmosphere, an oxide or a similar substance employed as a sintering aid may be reduced. Even when a second end of each power supply lead is not exposed from a surface of the substrate, oxidation of the insulative ceramic (particularly silicon nitride ceramic) substrate is promoted in an oxidizing atmosphere. In the above cases, heat treatment is also preferably performed in an inert atmosphere.

Meanwhile, the method for producing a glow plug of the present invention may include, prior to the brazing step, a glass layer forming step for forming a glass layer on the outer circumferential surface of a ceramic heater, in order to enhance adhesion between the ceramic heater and the brazing material (brazing material layer) during the brazing step for fixing the metallic sleeve to the ceramic heater. When the method includes the glass layer forming step, the heat treatment step is carried out prior to the glass layer forming step is critical.

Generally, the glass layer forming step includes applying a glass component to a desired portion of the outer circumferential surface of the ceramic heater and causing the coated ceramic heater to pass through a baking furnace in which the temperature is controlled to, for example, about 1,200° C. Seemingly, the glass layer forming step can also function as a heat treatment for enhancing flexural strength of the ceramic heater. However, when the temperature and heat treatment time of the glass layer forming step are adjusted in order to fully attain the effect of heat treatment of the ceramic heater, the glass layer itself is degraded (e.g., melted), thereby impairing a purpose for forming a suitable glass layer. Another possible approach is performing heat treatment after formation of a glass layer on the outer circumferential surface of the ceramic heater. However, when this approach is employed, heat treatment conditions such as heat treatment temperature and time must be limited in order to perform the heat treatment step while the glass layer is maintained in a proper state, possibly resulting in failure to fully perform the heat treatment step for enhancing flexural strength of the ceramic heater.

Therefore, the method for producing a glow plug of the present invention can include, prior to a glass layer forming step, an independent heat treatment step for enhancing flexural strength of the ceramic heater. Through the heat treatment step, the ceramic heater can be sufficiently heat-treated under arbitrary heat treatment conditions regardless of the conditions of the glass layer, and a subsequent brazing step can be performed on the ceramic heater which has a glass layer properly formed on its outer circumferential surface. Furthermore, as mentioned above, no particular limitations are imposed on the conditions of heat treatment performed in the heat treatment step carried out prior to the glass layer forming step. Thus, the heat treatment can be performed at sufficiently high temperature (the highest treatment temperature being higher than the highest temperature employed in the glass layer forming step), thereby efficiently yielding a ceramic heater endowed with excellent flexural strength through a comparatively short processing time.

The heat treatment can enhance the 3-point flexural strength of the ceramic heater produced according to the present invention (Sa) as measured through the aforementioned method by 5 to 35%, preferably 7 to 35%, more preferably 10 to 35%, as compared with the 3-point flexural strength (Sn) of a ceramic heater not having been subjected to this heat treatment. Particularly, when the heat treatment temperature falls within 1,150 to 1,450° C., the 3-point flexural strength can be greatly enhanced by 25 to 35% as compared with that of a heater which has not been subjected to this heat treatment, thereby sufficiently preventing damage of the heater such as fracture. Sa and Sn are averaged 3-point flexural strength values obtained by measuring five to ten ceramic heater samples which have been produced through similar processes and from the same materials.

In addition, the ceramic heater produced by the method of the present invention can attain a 3-point flexural strength (absolute value) of 500 to 1,000 MPa, preferably 700 to 1,000 MPa, more preferably 750 to 1,000 MPa. Since the ceramic heater has such a high flexural strength, the ceramic heater employed in, for example, a glow plug satisfactorily endures against external impact such as combustion pressure and is not broken during use. In addition, fracture of the ceramic heater can be prevented and cracking of a portion in the vicinity of connection portions between the heating resistor and power supply leads during production of a glow plug can be prevented; e.g., a brazing step for securing a ceramic heater inside a metal outer sleeve through brazing.

The aforementioned "green substrate" may be formed from powders of a variety of insulative ceramics selected in accordance with its application. A typical example is a green substrate which is predominantly formed of silicon nitride and provides sintered silicon nitride by firing. The silicon nitride content is preferably at least 80% by mass, more preferably at least 90% by mass, based on the entirety of the green substrate (100% by mass). The sintered silicon nitride may comprise silicon nitride particles and a grain boundary glass phase. In addition, a crystalline phase (e.g., disilicate phase) may be precipitated in the grain boundaries. The sintered silicon nitride may further contain aluminum nitride, alumina, and sialon, and the insulative ceramic powder is prepared in accordance with the composition of the sintered silicon nitride.

The aforementioned "green heating resistor" contains an electrically conductive ceramic and an insulative ceramic.

Examples of electrically conductive ceramics for use in the invention include silicides, carbides, nitrides, and borides of at least one metal element selected from among W, Ta, Nb, Ti, Mo, Zr, Hf, V, and Cr. Generally, the insulative ceramic is silicon nitride. In particular, the electrically conductive ceramic preferably has a thermal expansion coefficient approximately equal to that of the insulative ceramic (e.g., silicon nitride) or a material for forming a substrate (e.g., silicon nitride). When the electrically conductive ceramic has a small difference in thermal expansion coefficient from the insulative ceramic, generation of cracks in a portion in the vicinity of the interface between the substrate and the heating resistor can be prevented during use of the fired heater. Examples of such electrically conductive ceramics include WC, $MoSi_2$, TiN, and $WSi_2$. Preferably, the electrically conductive ceramic is endowed with high heat resistance; i.e., has a melting point higher than the operating temperature of the ceramic heater. When the melting point of the electrically conductive ceramic is high, the durability of the heater in an operating temperature range increases.

No particular limitation is imposed on the ratio of the amount of the electrically conductive ceramic to that of the insulative ceramic. However, when the entirety of a green heating resistor is 100 parts by volume, the amount of the electrically conductive ceramic is 15 to 40 parts by volume, preferably 20 to 30 parts by volume. The green heating resistor is fired, to thereby form a heating resistor, which is a type of resistor that generates heat through application of current.

The aforementioned "power supply leads" may be formed from a metal selected from among W, Re, Ta, Mo, Nb, etc. and alloys predominantly containing these metals. Among them, W is often used. No particular limitations are imposed on the external shape and cross sectional shape of the power supply leads.

DESCRIPTION OF THE REFERENCE NUMERALS

Figure 1:
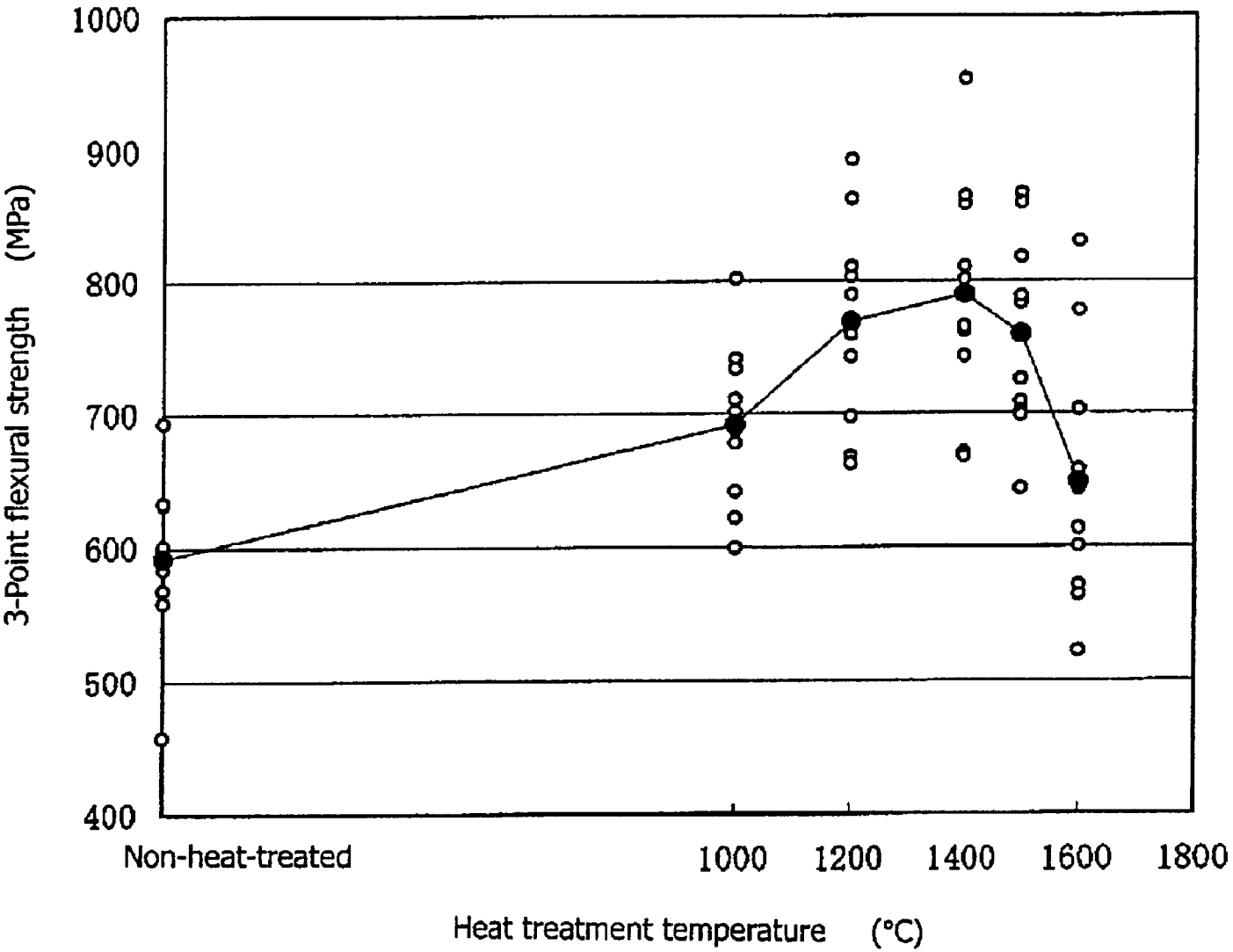
FIG. 1 is a graph showing the relationship between heat treatment temperature and 3-point flexural strength.

1: ceramic heater; 11: substrate (insulative ceramic substrate); 12: heating resistor; 13*a*, 13*b*: power supply leads; 13*c*, 13*d*: visible portions; 18: glass layer; 2: glow plug; 21: metallic sleeve; 22 metallic shell

DETAILED DESCRIPTION OF THE PREFERRED EMBODIMENT

The present invention will now be described in greater detail with reference to an embodiment shown in the drawings. However, the present invention should not be construed as being limited thereto.

Figure 3:
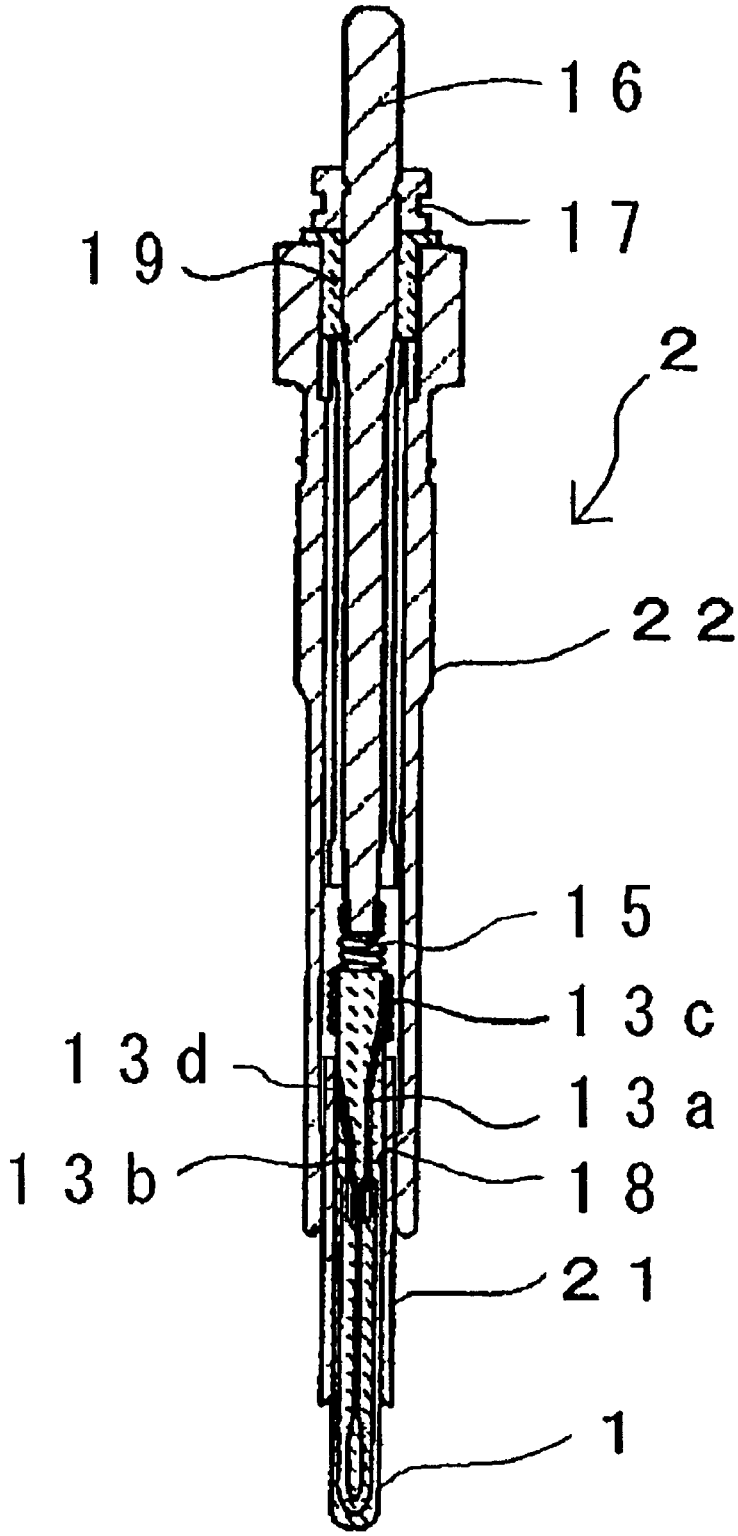
FIG. 3 is a cross-sectional view showing a glow plug incorporating a ceramic heater in its tip.

FIG. 3 shows the internal structure of a glow plug using a ceramic heater. A glow plug 2 includes a ceramic heater 1 at a front end portion, which serves as a heat generation portion. The ceramic heater 1 is disposed inside a metallic sleeve 21 formed of a ferrous metal such as stainless steel, such that a front end portion of the ceramic heater 1 projects from the metallic sleeve 21. The metallic sleeve 21 is held at a front end portion of a metallic shell 22 having a threaded portion that is formed thereon for mounting the glow plug 2 to an engine. One end portion of a lead coil 15 is fitted onto a rear end portion of the ceramic heater 1; and the other end portion of the lead coil 15 is fitted onto one end portion of a center rod 16 made of metal, which is inserted into the metallic shell 22. The other end portion of the center rod 16 extends toward the outside of the metallic shell 22, and the outer circumferential surface of the other end portion is screw-engaged with a nut 17. The center rod 16 is fixed to the metallic shell 22 by means of tightening the nut 17 toward the metallic shell 22. Further, an insulating bush 19 is fitted between the nut 17 and the metallic shell 22.

Figure 2:
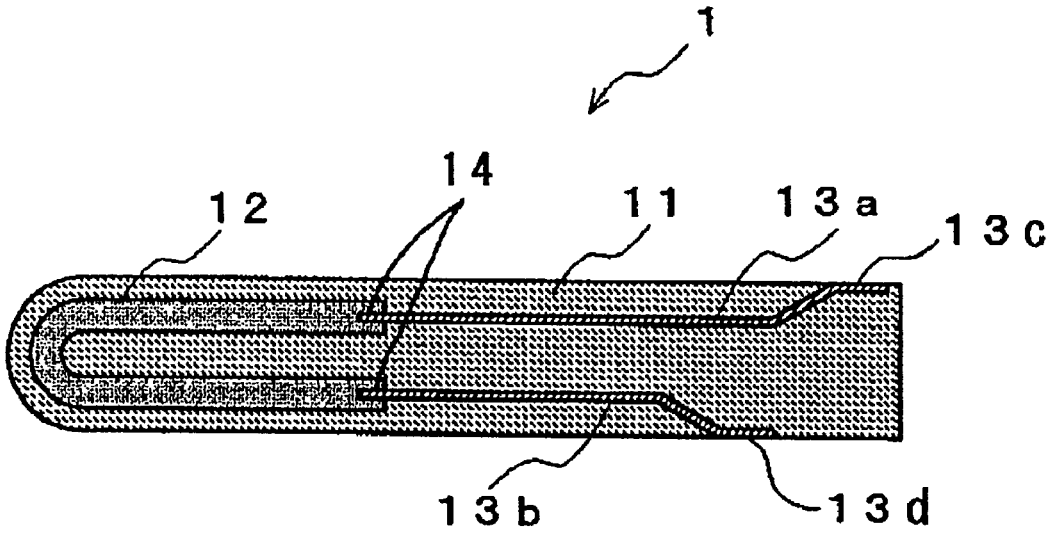
FIG. 2 is a cross-sectional view showing a ceramic heater.

As shown in FIG. 2, the ceramic heater 1 includes a substrate 11, a heating resistor 12, and power supply leads 13*a* and 13*b*. Notably, FIG. 2 shows a longitudinal cross section of the ceramic heater 1. The substrate 11 is formed of sintered silicon nitride and protects the heating resistor 12 and the power supply leads 13*a* and 13*b*, which are buried therein. The heating resistor 12 is formed of a conductive ceramic and an insulative ceramic and assumes a generally U-like shape including a portion extending from one end, a direction changing portion, and a portion extending towards the other end. Electric power externally supplied to the ceramic heater 1 is fed to the heating resistor 12 via the power supply leads 13*a* and 13*b*, which are made of, for example, W. In order to enable supply of electrical power to the heating resistor 12, first ends of the power supply leads 13*a* and 13*b* are connected to the two end portions of the heating resistor 12 to thereby form connection portions (fitting portions) 14 between the power supply leads 13*a* and 13*b*, and the heating resistor 12. The power supply leads 13*a* and 13*b* extend in a direction away from the heating resistor 12 within the substrate 11; and second ends of the power supply leads 13*a* and 13*b* are exposed at the outer peripheral surface of the substrate 11, whereby visible portions (exposed portions) 13*c* and 13*d* are formed.

Turning back to FIG. 3, by means of a predetermined method (e.g., plating or vapor phase deposition), a metallic thin film (not shown) of, for example, nickel is formed on the circumferential surface of the substrate 11 in a region including the visible portion of one of the power supply leads 13*a* and 13*b*; e.g., the visible portion 13*d* of the power supply lead 13*b*. The substrate 11 is joined to the metallic sleeve 21 via the metal thin film by means of brazing, and the power supply lead 13*b* is in electrical communication with the metallic sleeve 21 via the visible portion 13*d*. Similarly, another metallic thin film (not shown) is formed on the circumferential surface of the substrate 11 in a region including the visible portion 13*c* of the other power supply lead 13*a*; and the lead coil 15 is brazed thereto. By virtue of the above structure, power is supplied from an unillustrated power source to the heating resistor 12 via the center rod 16, the lead coil 15, and the power supply lead 13*a*; and the heating resistor 12 is grounded via the power supply lead 13*b*, the metallic sleeve 21, the metallic shell 22, and an unillustrated engine block. Due to the power supply, the heating resistor generates heat.

The metallic sleeve 21 and the metallic shell 22 are mutually joined by means of brazing. Further, the metallic sleeve 21 is joined to the ceramic heater 1 via a glass layer 18 in contact with the circumferential surface of the ceramic heater 1 (the substrate 11) and a brazing material layer disposed between the outer circumferential surface of the glass layer 18 and the inner circumferential surface of the metallic sleeve 21 (the glass layer 18 is removed at portions corresponding to the visible portions 13*c* and 13*d* of the power supply leads 13*a* and 13*b*). The glass layer 18 is formed of a glass matrix and aggregate particles of, for example, alumina, dispersed therein. Such glass matrix is formed from borosilicate glass that contains Si (70 wt % to 90 wt % as reduced to $SiO_2$) and B (10 wt % to 30 wt % as reduced to $B_2O_3$). The amount of the aggregate particles is adjusted to fall within a range of 10% to 40%, as represented by a percent area of aggregate particles as viewed on a surface of the glass layer. The brazing material layer is formed of a brazing material having a liquidus temperature of 700° C. or higher to lower than 1,200° C.; e.g., Ag-containing brazing material such as Ag—Cu brazing material.

In the present invention, the ceramic heater can be manufactured by the following method.

Electrically conductive ceramic powder, insulative ceramic powder (specifically, ceramic powder containing silicon nitride as a predominant component), and a sintering aid are used for providing a material for forming a green heating resistor. Although powder of a rare earth oxide is frequently used as a sintering aid, powder of another oxide, such as $Al_2O_3$ or $SiO_2$, which is generally used in firing of silicon nitride may be used. Although these sintering aids may be used singly, in general, two or more types of sintering aids are used in combination; e.g., powder of a rare earth oxide and powder of $Al_2O_3$, or powder of a rare earth oxide and powder of $SiO_2$. Notably, use of $Y_2O_3$, $Er_2O_3$, or $Yb_2O_3$ as a rare earth oxide is preferable, because a resultant grain boundary phase (crystalline phase) has increased heat resistance.

The electrically conductive ceramic powder, the insulative ceramic powder, and the sintering aid powder are mixed at predetermined proportions to thereby prepare a mixture powder. This mixing may be performed through an ordinary process such as a wet process.

When the total amount of the electrically conductive ceramic powder, the insulative ceramic powder, and the sintering aid powder is defined to be 100 parts by volume, the amount of the electrically conductive ceramic powder is set to 15 to 40 parts by volume, preferably 20 to 30 parts by volume, whereas the total amount of the insulative ceramic powder and the sintering aid powder is set to 85 to 60 parts by volume, preferably 80 to 70 parts by volume.

After addition of a proper amount of a binder and other necessary materials to the thus-prepared mixture powder, the resultant mixture powder is formed into a generally U-shaped green heating resistor through molding such as injection molding. First ends of paired power supply leads formed of a metal such as W are fixedly attached to the respective ends of the generally Ushaped green heating resistor in such a manner that the first ends are embedded in the corresponding ends.

Subsequently, the generally U-shaped green heating resistor having the paired power supply leads connected thereto is buried in substrate material powder which contains powder of an insulative ceramic as a predominant component, as well as powder of an electrically conductive ceramic and powder of a sintering aid at predetermined proportions. Specifically, two half green compacts are prepared by pressing the substrate material powder such that each of the half green compacts has a depression for receiving the green heating resistor and the power supply leads. The green heating resistor having the power supply leads is placed between the half green compacts, and these elements are then press molded. Subsequently, a pressure of about 5 to 12 MPa is applied to these elements together, to thereby obtain a green ceramic heater having a structure such that the green heating resistor and the power supply leads are embedded in a powder compact assuming the shape of the substrate. After debindering, the green ceramic heater is placed in a pressure-application die made of, for example, graphite, which is then placed in a firing furnace. In the furnace, the green ceramic heater is subjected to hot-press firing for a desired period of time at a predetermined temperature in an inert atmosphere, whereby a sintered body (a ceramic heater) is obtained. Although no particular limitations are imposed on the firing temperature and the firing time, the firing temperature is generally set to 1,650 to 1,850° C., preferably, 1,700 to 1,800° C., and the firing time is generally set to 30 to 150 minutes, preferably 60 to 90 minutes.

The ceramic heater obtained through the above-described heater forming step is then polished in a subsequent polishing step. Specifically, the outer circumferential surface of the substrate (ceramic heater) is polished by a predetermined amount so as to expose the second ends of the power supply leads from the outer circumferential surface of the substrate. The polished ceramic heater is placed in a heating furnace and subjected to heat treatment (heat treatment step), whereby a ceramic heater having improved flexural strength is produced. Notably, in the heat treatment step, heat treatment is performed for 10 minutes to 4 hours at 900 to 1600° C. in an inert atmosphere (specifically, a nitrogen gas atmosphere). The highest temperature in the heat treatment step is preferably set at a temperature equal to or higher than the highest temperature in a glass layer forming step, which will be described later, in order to obtain an effect of increasing flexural strength through heat treatment within a short period of time. For example, the highest temperature in the heat treatment step is set to 1,400° C., and the highest temperature in the glass layer forming step is set to 1,200° C.

Next, an example method of producing the glow plug 2 shown in FIG. 3 will be described.

Glass powder is prepared from powder of a Si source, a B source, etc., which form borosilicate glass. Alumina powder serving as aggregate particles, clay minerals, and an organic binder are mixed in the glass powder in proper amounts, and water is further added thereto, followed by mixing to thereby obtain a glass powder slurry. In the glass layer forming step, the glass powder slurry is applied to the outer circumferential surface of the ceramic heater 1 obtained through the above-described heater forming step, polishing step, and heat treatment step, to thereby form a glass powder layer, which is then dried. The ceramic heater 1 carrying the dried glass powder layer is inserted into a heating furnace and heated to a predetermined temperature (e.g., 1200° C.), whereby the glass powder layer is baked so as to form the glass layer 18 on the outer circumferential surface of the ceramic heater 1.

A brazing step is performed subsequent to the glass layer forming step. First, the metallic sleeve 21 is disposed coaxially with the ceramic heater 1 to surround the glass layer 18 of the ceramic heater 1, such that a clearance of 0.05 to 0.15 mm is formed between the inner circumferential surface of the metallic sleeve 21 and the outer circumferential surface of the glass layer 18. Subsequently, an assembly in which a brazing material is placed between the inner circumferential surface of the metallic sleeve 21 and the outer circumferential surface of the glass layer 18 is fabricated and is disposed in a heating furnace. In the heating furnace, the assembly is heat-treated (for brazing) in a predetermined temperature range in the atmosphere. As a result, the brazing material is melted and fills the space between the metallic sleeve 21 and the glass layer 18. Subsequently, the assembly is cooled in the furnace or in the air so as to solidify the molten brazing material to thereby form a brazing material layer. Subsequently, by employing a method known to those of ordinary skill in the art, the lead coil 15, the center rod 16, the metallic shell 22, etc., are assembled on the ceramic heater 1 having been joined to the metallic sleeve 21, so as to obtain the glow plug 2.

EXAMPLES

A variety of ceramic heater samples were prepared according to the present invention as described below, and the samples were evaluated.

(1) Production of Ceramic Heaters

Powders of $Yb_2O_3$ (10 mass %) and $SiO_2$ (4 mass %), serving as sintering aids, were incorporated into a $Si_3N_4$ powder (86 mass %), to thereby yield an insulating raw material. Forty parts by mass (hereinafter referred to as "parts") of the resultant material was mixed with 60 parts of electrically conductive ceramic WC powder, to thereby yield a raw material for forming a green heating resistor. The raw material for forming a green heating resistor was subjected to wet-mixing for 72 hours then drying, to thereby obtain a mixture powder. Subsequently, the resultant powder and a binder were fed to a kneader, and the mixture was kneaded for four hours. The kneaded product was cut into pellets. A pair of tungsten leads were disposed at predetermined locations of a mold for injection molding, and the kneaded product in pellet form was injection molded by means of an injection molding apparatus, to thereby obtain a generally U-shaped green heating resistor whose ends are connected to one ends of the respective leads.

$Si_3N_4$ (86 mass %), $Yb_2O_3$ (11 mass %), $SiO_2$ (3 mass %), and $MoSi_2$ (5 mass %), all in powder form, were wet-mixed for 40 hours, granulated through spray drying, and compacted, to thereby yield two green compact halves, each having a cavity for receiving the green heating resistor and power supply leads. Subsequently, the green heating resistor was placed between the two green compact halves, followed by press molding under an applied pressure of 6.9 MPa for integration, to thereby obtain a green ceramic heater. The thus obtained green ceramic heater was calcined at 600° C. to remove binder components. Thereafter, the calcined product was placed in a graphite-made die set, and subjected to hot-press-firing in a nitrogen atmosphere at 180° C. for 1.5 hours under an applied pressure of 24 MPa, to thereby yield a sintered product. The sintered product was polished to a predetermined depth, so that one end of each power supply lead was exposed to the outside from the outer circumferential surface of the substrate. Thus, a ceramic heater having a round cross section, when cut in a vertical direction with respect to the shaft, was obtained (diameter: 3.5 mm).

Sixty ceramic heaters (test samples) were produced in the above-described manner. Of the 60 samples, 10 were not heat treated. The remaining 50 samples were grouped into 5 sets, each consisting of 10 samples, and the respective sets were heat-treated at 1,000° C., 1,200° C., 1,400° C., 1,500° C., or 1,600° C. The heat treatment was performed as follows: A set of ten ceramic heaters was placed in a heating furnace, which had been adjusted to have a predetermined chamber temperature, and the ceramic heaters were heated in a nitrogen atmosphere, under ambient pressure, for 1 hour. After completing the heat treatment, power supply to the furnace was stopped, and the heated products were allowed to cool to room temperature. Then the ceramic heaters were removed from the furnace.

(2) 3-Point Flexural Strength Test 3-point flexural strength was measured by the following method with respect to 50ceramic heaters which had undergone the heat treatment described above in (1), and 10 ceramic heaters which had not been heat-treated.

A load was applied to the surface of the substrate of each of the ceramic heaters to be tested in a region corresponding to the power supply leads buried in the ends of the heating resistor, according to JIS R 1601: span 12 mm; crosshead moving rate 0.5 mm/min; and temperature 25° C. Specifically, a load was applied to the surface of each substrate at a middle position of the axial length between the end face of the heating resistor and the end of a buried portion of the lead. FIG. 1 shows the test results. In FIG. 1, the mark "o" represents 3-point flexural strength with respect to five groups of heat-treated ceramic heaters. each group consisting of 10 ceramic heaters (five groups total 50 ceramic heaters) and the groups being heat-treated at different temperatures, and 10 non-heat-treated ceramic heaters. The mark "●" represents the averaged 3-point flexural strength of 10 ceramic heaters of each group.

As shown in FIG. 1, the average 3-point flexural strength of 10 non-heat-treated ceramic heaters is 592 MPa, and the average 3-point flexural strength of 10 heat-treated ceramic heaters of each group is as follows: 691 MPa (1,000° C.); 769 MPa (1,200° C.); 789 MPa (1,400° C.); 759 MPa (1,500° C.); and 648 MPa (1,600° C.). Thus, the heat treatment enhances the average 3-point flexural strength by at least 9.5%. Particularly, heat treatment at 1,200 to 1,500° C. enhances the average 3-point flexural strength by 28.2% to 33.3%. Further, the lowest 3-point flexural strength attained after heat treatment at 1,200 to 1,500° C. represents an enhancement of 8.6% to 12.7%. These test results show that a fired ceramic heater which has undergone a specific heat treatment exhibits sufficient fracture resistance during production thereof and endures external impact such as combustion pressure and exhibits sufficient fracture resistance, even when the ceramic heater is used in a glow plug.

It should further be apparent to those skilled in the art that various changes in form and detail of the invention as shown and described above may be made. It is intended that such changes be included within the spirit and scope of the claims appended hereto.

This application is based on Japanese Patent Application Nos. 2001-367385 filed Nov. 30, 2001 and 2002-306313 filed Oct. 21, 2002, the disclosures of which are incorporated herein by reference in their entirety.

What is claimed is:

1. A method for producing a glow plug having a metallic sleeve and a ceramic heater which includes a substrate formed of an insulative ceramic, a heating resistor buried in the substrate, and a pair of power supply leads buried in the substrate, a first end of each power supply lead being connected to a corresponding end of the heating resistor, and the ceramic heater being fixed inside the metallic sleeve, which method comprises:

firing a green ceramic heater in a heater forming step;

heat treating the resultant ceramic heater obtained in the heater forming step at a temperature of from 900 to 1,600° C. in a heat treatment step;

fixing the heat-treated ceramic heater obtained in the heat treatment step inside the metallic sleeve in a brazing step; and polishing the fired ceramic heater after firing in the heater forming step, to expose a second end of each power supply lead at a surface of the substrate, and after the polishing, heat treating the polished ceramic heater in an inert atmosphere wherein the green ceramic heater includes a green substrate which is formed of an insulative ceramic powder and which provides the substrate upon firing; a green heating resistor, which contains an electrically conductive ceramic and an insulative ceramic, and is buried in the green substrate and which provides the heating resistor upon firing; and a pair of power supply leads which are buried in the green substrate, a first end of each power supply lead being connected to a corresponding end of the green heating resistor.

2. The method for producing a glow plug as claimed in claim 1, wherein the ceramic heater has a glass layer on its outer circumferential surface and said method comprises fixing the ceramic heater inside the metallic sleeve by brazing via the glass layer, and forming the glass layer on the outer circumferential surface of the ceramic heater in a glass layer forming step performed after the heat treatment step.

3. A method for producing a glow plug as claimed in claim 2, wherein the highest temperature in the glass layer forming step is equal to or lower than the highest temperature in the heat treatment step.

4. The method for producing a glow plug as claimed in claim 1, wherein the ceramic heater has a glass layer on its outer circumferential surface and said method comprises fixing the ceramic heater inside the metallic sleeve by brazing via the glass layer, and forming the glass layer on the outer circumferential surface of the ceramic heater in a glass layer forming step performed after the heat treatment step.

* * * * *